US005191917A

United States Patent [19]

Krumm et al.

[11] Patent Number: 5,191,917

[45] Date of Patent: Mar. 9, 1993

[54] SPREADER TOOL FOR COUPLING AND DECOUPLING HEALD SHAFTS IN A LOOM

[75] Inventors: Valentin Krumm, Hergensweiler; Armin Hiemer, Lindau, both of Fed. Rep. of Germany

[73] Assignee: Lindauer Dornier Gesellschaft mbH, Lindau, Fed. Rep. of Germany

[21] Appl. No.: 822,602

[22] Filed: Jan. 17, 1992

[30] Foreign Application Priority Data

Jan. 19, 1991 [DE] Fed. Rep. of Germany ..... 4101532

[51] Int. Cl.[5] ..... D03C 13/00; D03C 9/06

[52] U.S. Cl. ..... 139/380; 81/485; 29/230; 29/239; 139/57

[58] Field of Search ..... 81/485, 486; 29/225, 29/230, 239; 139/82, 380, 57

[56] References Cited

U.S. PATENT DOCUMENTS 3,696,842 10/1972 Pfarrwaller ..... 139/57

4,793,224 12/1988 Huang ..... 81/486 X

FOREIGN PATENT DOCUMENTS 2656380 6/1978 Fed. Rep. of Germany .

*Primary Examiner*—Andrew M. Falik

*Attorney, Agent, or Firm*—W. G. Fasse

[57] ABSTRACT

A spreader tool for the individual coupling and decoupling of heald shafts to or from the respective drive rods or shaft pulls of a heald loom is constructed to be inserted into a gap between two connecting spring sections from above the loom healds for spreading the connecting spring sections apart. The tool has two jaws that are normally biased into their closed position by a spring for insertion into the gap and are then spread apart by a cam drive or the like. The assembly and disassembly is thus greatly facilitated and the time previously required for this type of work has been substantially reduced.

10 Claims, 2 Drawing Sheets

SPREADER TOOL FOR COUPLING AND DECOUPLING HEALD SHAFTS IN A LOOM

FIELD OF THE INVENTION

The invention relates to a spreader tool for individually connecting and disconnecting the heald shafts to or from the drive rods or heald shaft pulls in a heald weaving loom.

BACKGROUND INFORMATION

In a weaving operation it is important that the heald shafts of the loom are properly connected to the heald shaft drives in order to assure the proper formation of the loom shed during weaving. Similarly, it is necessary to efficiently disconnect the heald shafts from the heald frame drive when a weaving harness is to be exchanged. For this operation it is necessary that each individual heald shaft is either disconnected or again connected with a drive rod on the outer right side and on the outer left side of the respective heald shaft.

German Patent Publication (DE-OS) 2,656,380 discloses an apparatus for connecting the heald shafts with the drive mechanism of a loom. The problem of connecting and disconnecting has been solved in this publication in that the drive rods are provided with claws in the area where they are to be connected with the heald shafts and in that a spacing is formed between the two rod sections that are made of spring material. An operating key is passed through this spacing after the locks of all heald shafts and the respective control elements are at least aligned in a row so that all heald shafts are at the same level. This operating key has an elliptic cross-section.

By operating said operating key, the drive rods are temporarily spaced apart in order to decouple the heald shafts from the drive rods or drive pulls.

Such an apparatus is effective for its purpose. However, the known apparatus requires a substantial effort for the leveling of the heald shafts and this effort is quite time consuming, especially when the loom comprises a large number of heald shafts. Even if the number of heald shafts is relatively small, the required precautions or rather efforts for the decoupling also do not appear to be in any useful relationship if compared with other measures for the decoupling. Another drawback of the known apparatus is seen in that it requires additional features in the loom, such as support bearings in front of and behind of the heald shafts for guiding the operating key.

Further, operating such a key is difficult because the clamping connections between the drive rod and the heald shaft are located in an area of the loom that is difficult to access by an operator. Another problem resides in the fact that the operating key must be introduced from the rear of the loom, namely from the side of the warp beam. Thus, introducing the operating key into the opening formed between the two clamping cheeks or jaws, may result in damage to the warp threads.

OBJECTS OF THE INVENTION

In view of the foregoing it is the aim of the invention to achieve the following objects singly or in combination:

to provide a tool which makes possible an individual coupling and decoupling of the drive rod and the respective heald shaft independently of the instantaneous position of the heald shafts;

to avoid the additional requirements and precautions in the area of the drive rods and heald shafts as they are necessary in the prior art; and to make sure that an exchange of the loom harness will be possible efficiently in an optimally short time.

SUMMARY OF THE INVENTION

A spreader tool according to the invention is characterized in that a rod shaped handle and turning device carries at its free end opposite the handle a spreader or drive cam that has an oval or elliptic configuration, whereby the spreader cam is positioned between a first and a second spreader jaw. Further, the spreader cam is rotatably mounted on one of the spreader jaws and both spreader jaws are journalled to a common journal pin located at an end opposite the spreading end of the spreader jaws, and wherein the spreader jaws are biased by a tension or cocking spring in a direction opposite the spreading direction. Thus the spring biases the jaws closed.

According to a further embodiment of the invention, the two spreader jaws are positioned opposite one another and have such a profile that their free ends contact each other at least along a portion of their length when the spreader jaws of a pair are not spread apart. This feature of the invention makes it possible for the operator of this tool to insert the spreader tool into the gap between the spring sections of the drive rod for performing a spreading operation in the gap. The spreader jaws have a configuration comparable to a reversed Z-profile, whereby the web portion of one Z-configuration is somewhat longer than the respective web of the other Z-configuration of a pair of spreader jaws. In the longitudinal direction front portions of the spreader jaws contact each other in a congruent manner when these front portions that form the operating end of the spreader tool, are not spread apart. In this condition, with the operating ends not spread, the opposite ends of the spreader jaws extend in parallel to each other. Thus, the operating ends are located on one side of the respective web of the Z-configuration, while the opposite ends of the spreader jaws are located on the other side of the Z-web. One of the two spreader jaws carries a mounting shield or bracket secured to each narrow side of the respective jaw. This mounting bracket has a U-shaped recess in which a journal stud of the drive cam is received. The cam or spreader member is oval or elliptical and rotation of the spreader member spreads the jaws against the biasing force of a biasing spring.

One end of the journal stud has a flange to prevent an axial displacement of the spreader cam. The other end of the journal stud has attached thereto a connector piece that in turn is connected to the free end of the handle of the spreader cam. The handle is secured to the connector element by a cross-pin.

The rear ends of the spreader jaws carry mounting brackets in which a common axle is received. The biasing spring for closing the spreader jaws is mounted on a middle section of the common axle between the mounting brackets. The biasing spring has clamping legs reaching around the respective spreader jaw so that an end leg of the respective clamping bail bears on the broad side of the respective spreader jaw, whereby the spreader jaws are biased into a closed position, since the biasing force of the spring is directed opposite to the spreading out direction caused by rotation of the drive cam.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
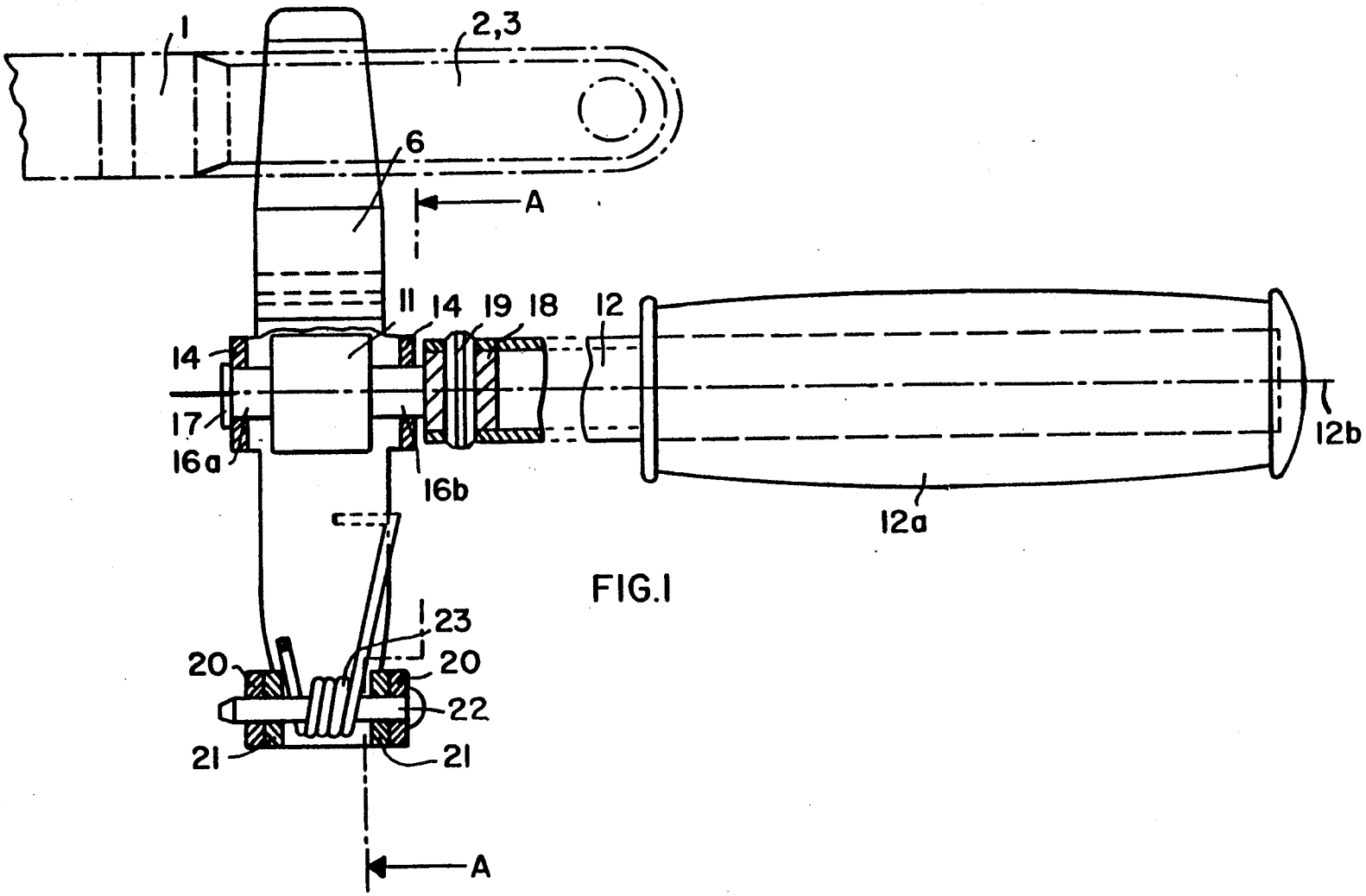
FIG. 1 illustrates an elevational side view of a spreader tool according to the invention in a position between the spring sections of a drive rod, whereby the tool is shown partially in section.

FIG. 1 shows in dash-dotted lines a drive rod 1 for operating a respective heald shaft in a loom. The heald shaft is secured to the drive rod 1 through leaf spring sections 2 and 3 that are normally closely spaced from each other by a gap 4 best seen in FIG. 2.

Figure 3:
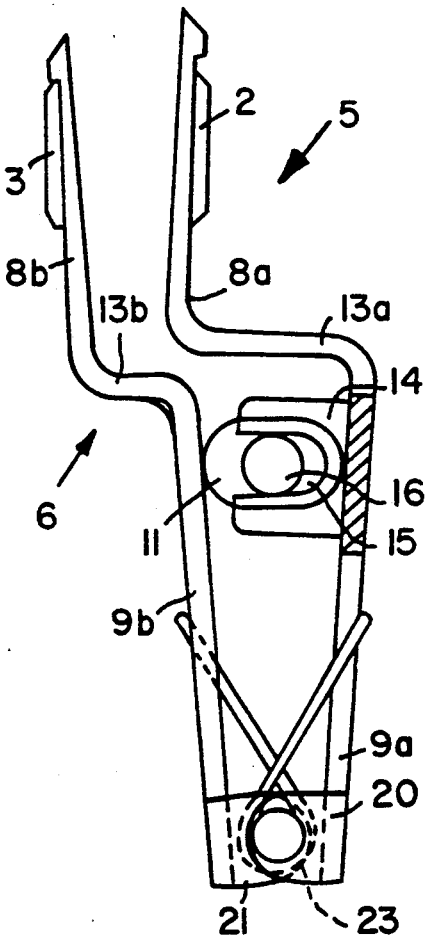
FIG. 3 is a sectional view similar to that of FIG. 2, however, showing the jaws of the spreader tool in an open position for biasing the heald mounting spring sections apart.
Figure 2:
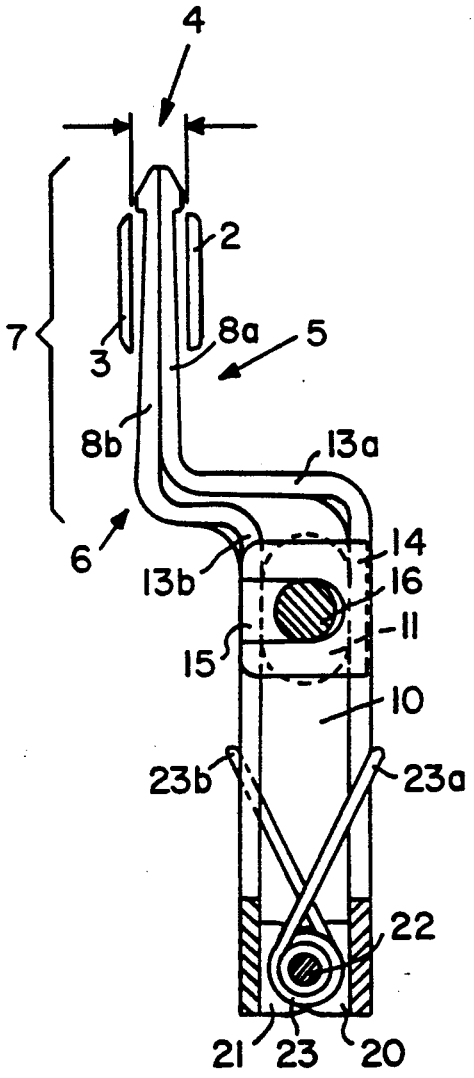
FIG. 2 is a sectional view along section line A—A in FIG. 1, showing the spreader tool in its closed condition between two spring sections of the drive rod for a heald shaft.

The present spreading tool has two jaws 5 and 6 as best seen in FIG. 2. These jaws have an upper operating leg 8*a* and 8*b* and a lower hinging leg 9*a* and 9*b* as best seen in FIG. 3. The upper legs 8*a* and 8*b* are shorter, as shown at 7, than the lower hinging legs 9*a* and 9*b*. Thus, two of these jaws 5, 6 form in combination a spreader tool. The shorter operating end 7 of the spreader tool, is insertable into the gap 4 when the shorter operating legs 8*a* and 8*b* extend in parallel to each other thereby contacting each other as shown in FIG. 2 illustrating the closed tool position prior to spreading, with the operating legs 8*a*, 8*b* congruent or in register with each other.

As best seen in FIGS. 2 and 3, each of the two jaws 5 and 6 has a reversed Z-configuration, whereby the upper, shorter operating legs 8*a* and 8*b* are connected to the respective longer lower hinging leg 9*a* and 9*b* by a corresponding Z-web 13*a* and 13*b*. The Z-web 13*a* is longer than the respective Z-web 13*b* to provide a space 10 between the two lower hinging legs 9*a* and 9*b* to accommodate an operating drive cam 11 for spreading the legs apart as shown in FIG. 3 or for permitting the legs to close the shorter operating legs 8*a* and 8*b* as shown in FIG. 2, and to also accommodate a hinging pin 22 and a tool closing biasing spring 23 mounted on the hinging pin 22.

The operating cam 11 has an elliptical or oval configuration arranged so that with its length axis horizontal it spreads the jaws, while in its vertical position the cam 11 permits the operating legs 8*a* and 8*b* to contact each other. The operation will be described in more detail below.

One of the two spreader jaws 5, 6 carries on both of its narrow sides near the Z-web on the longer leg 9*a* or on the longer leg 9*b*, a respective mounting shield 14 provided with a U-shaped recess 15 for receiving a cylindrical journal stud 16 which carries the operating cam 11. As shown in FIG. 1, the left-hand end 16*a* of the journal stud 16 is provided with a flange 17 to prevent axial shifting of the journal stud with its operating cam 11. The right-hand end 16*b* of the stud 16 is connected to a connector piece 18 reaching into a handle shaft 12 of a handle 12*a*. A securing pin 19 rigidly secures the connector piece 18 and thus the operating cam 11 through the shaft 12 to the handle 12*a*. Thus, turning the handle 112*a* manually in one or the other direction will bring the operating cam 11 into the horizontal or vertical positions as shonw in FIGS. 2 or 3. The handle axis 12*b* extends substantially perpendicularly to the longitudinal extension of the jaws.

Referring to FIGS. 1, 2, and 3 in conjunction, the two lower legs 9*a* and 9*b* are hinged to each other by a hinging pin 22. For this purpose, the lower leg 9*a* is provided with two mounting brackets 20, while the other lower leg 9*b* is provided with respective mounting brackets 21. The hinging pin 22 passes through aligned through-bores in the brackets 20, 21 as best seen in FIG. 1. The hinging pin 22 thus forms the common journal axis for the two spreader jaws 5 and 6 to permit the desired spreading movement. Additionally, the hinging pin 22 serves as a mounting for the biasing spring 23 provided with two spring legs 23*a* and 23*b* engaging the respective one of the long legs 9*a*, 9*b* of the jaws 5, 6. The spring 23 is so biased that it normally tends to hold the spreader jaws in the closed position of FIG. 2. The angled legs 23*a*, 23*b* bear against the outer broad surfaces of the lower hinging legs 9*a*, 9*b*.

The present spreader tool operates as follows. If it becomes necessary to connect or disconnect a heald shaft from its drive rod, the operating end 7 of the spreader jaws 5, 6 is brought into the gap 4 as shown in FIG. 2. For proper operation, the handle 12*a* with its shaft 12 has a length which corresponds at least to a length larger than the vertical height of the heald shafts. When the tool is in the position of FIG. 2, the handle is rotated to bring the operating cam 11 from the vertical position shown in FIG. 2 into the horizontal position shown in FIG. 3, whereby the spring sections 2 and 3 are spread apart. As a result, the drive rod 1 is separated or released from the heald shaft not shown, whereby the drive rod 1 can be tilted out of the position in which it is connectable to the heald shaft. Since the biasing spring 23 always tends to counteract the spreading function, the jaws will return automatically into the position of FIG. 2, once the drive rod and heald shaft have been either connected or disconnected.

Rather than using a mechanical spreader cam 11, it is possible to use a pneumatic, hydraulic, or electric drive to cause the described spreading. Such drive mechanisms as such are known and therefore not shown in any further detail.

The spreader tool according to the invention makes it possible to avoid the time consuming leveling of the heald shafts and their respective drive rods, thereby enabling a rapid coupling and decoupling of the drive rods from their respective heald shafts. Another substantial advantage of the present spreader tool is seen in that assembly and disassembly work in the lower zone of the loom are avoided. This advantage is especially important because the lower loom zone is hard to access by an operator. This is possible because with the present tool the coupling zone between drive rod and heald shaft can be accessed without any trouble from the upper side of the loom, that is from above the heald shafts.

Although the invention has been described with reference to specific example embodiments, it will be appreciated, that it is intended to cover all modifications and equivalents within the scope of the appended claims.

What we claim is:

1. A spreader tool for the individual coupling and decoupling of a heald shaft to or from respective drive means in a heald loom, comprising a first spreader jaw and a second spreader jaw forming a pair of spreader jaws, means for journalling said spreader jaws to each other at their ends opposite to a spreading end of said spreader jaws, said journalling means permitting rotation of said spreader jaws about a common axis, means for normally biasing said spreader jaws into a jaws closed position, and drive means for opening said spreader jaws in a direction opposite to an effective direction of said biasing means, said drive means comprising a drive cam (11), a handle secured to said drive cam, and means for mounting said drive cam between said spreader jaws, whereby rotating said handle rotates said drive cam to move said spreader jaws away from each other.

2. The spreader tool of claim 1, wherein said spreader jaws (5, 6) have a reversed Z-profile including first legs, second legs, and profile webs interconnecting the respective first and second legs of said spreader jaws to each other.

3. The spreader tool of claim 2, wherein each of said webs of said pair of spreader jaws has a different length between the respective first and second leg.

4. The spreader tool of claim 2, wherein said first legs of said pair of spreader jaws form an operating tool end in which said first legs are arranged in a longitudinal direction and so as to be congruent or nesting one on the other in said jaws closed position, and wherein said second legs form a rear tool end in which said second legs of said spreader jaws are arranged in parallel to each other when said spreader tool is closed to form a space (10) between said second legs.

5. The spreader tool of claim 4, wherein one of said parallel extending second legs of said spreader jaws comprises at each narrow side thereof a mounting shield (14) for supporting said drive means in said space between said parallel second legs.

6. The spreader tool of claim 1, wherein said journalling means comprise a journal pin (22), said first and second spreader jaws comprising mounting bracket means for mounting said spreader jaws to said journal pin (22).

7. The spreader tool of claim 6, wherein said journal pin (22) provides a mounting for said biasing means.

8. The spreader tool of claim 7, wherein said biasing means comprise a helical spring with two legs bearing against the respective one of said spacer jaws.

9. The spreader tool of claim 1, wherein one of said spreader jaws comprises two mounting shields (14) for mounting said drive cam.

10. The spreader tool of claim 1, wherein said handle and drive cam have a rotational axis (12*b*) extending substantially perpendicularly to a longitudinal extension of said spreader jaws forming a pair.

* * * * *

UNITED STATES PATENT AND TRADEMARK OFFICE

CERTIFICATE OF CORRECTION

PATENT NO. : 5,191,917

DATED : March 9, 1993

INVENTOR(S) : Valentin Krumm, et al

It is certified that error appears in the above-indentified patent and that said Letters Patent is hereby corrected as shown below:

Column 6, line 22, replace "spacer" by --spreader--.

Signed and Sealed this

Twenty-third Day of November, 1993

*Attest:*

*Attesting Officer*

Bruce Lehman

BRUCE LEHMAN

*Commissioner of Patents and Trademarks*